United States Patent [19]

Ohkubo et al.

[11] Patent Number: 4,928,653

[45] Date of Patent: May 29, 1990

[54] AIR-FUEL RATIO CONTROL DEVICE FOR AN INTERNAL COMBUSTION ENGINE

[75] Inventors: Satoru Ohkubo, Amagasaki; Toshio Iwata, Himeji, both of Japan

[73] Assignee: Mitsubishi Denki Kabushiki Kaisha, Japan

[21] Appl. No.: 329,287

[22] Filed: Mar. 27, 1989

[30] Foreign Application Priority Data

Apr. 19, 1988 [JP] Japan ..... 63-97865

[51] Int. Cl.[5] ..... F02D 41/14

[52] U.S. Cl. ..... 123/435; 364/431.05

[58] Field of Search ..... 123/425, 435; 364/431.05

[56] References Cited

U.S. PATENT DOCUMENTS

| | | | |
|---|---|---|---|
| 4,622,939 | 11/1986 | Matekunas | 123/435 X |
| 4,732,126 | 3/1988 | Ikeura et al. | 123/435 |
| 4,753,204 | 6/1988 | Kojima et al. | 123/440 |
| 4,800,500 | 1/1989 | Tanaka | 123/435 X |

FOREIGN PATENT DOCUMENTS

| | | | |
|---|---|---|---|
| 107826 | 6/1983 | Japan | 123/435 |
| 60-212643 | 10/1985 | Japan . | |

*Primary Examiner*—Tony M. Argenbright

*Attorney, Agent, or Firm*—Leydig, Voit & Mayer

[57] ABSTRACT

An air-to-fuel ratio control device for an internal combustion engine is disclosed, which comprises a pressure sensor for detecting the pressure P within a cylinder of the engine, and means for computing an actual value of the ratio $(dP/d\theta)max/Pmax$, wherein $(dP/d\theta)max$ is the maximum rate of change in pressure P within the cylinder with respect to the crank angle $\theta$ and Pmax is the maximum pressure in the cylinder during a predetermined interval in a cycle of the cylinder. A target value of the ratio $(dP/d\theta)max/Pmax$ is obtained by converting the optimum air-to-fuel ratio corresponding to the operating condition of the engine, the conversion being effected by means of a relationship established between the values of the air-to-fuel ratio and those of the ratio $(dP/d\theta)max/Pmax$. A control element controls the amount of injected fuel to reduce the deviation of the actual value of the ratio $(dP/d\theta)max/Pmax$ with respect to the target value thereof.

17 Claims, 9 Drawing Sheets

FIG. 3

| Tp (ms) | 800 | 2000 | 3200 | 4000 | 4800 | 5600 | 6400 |
|---|---|---|---|---|---|---|---|
| | 20 | 30 | 30 | 40 | 40 | 40 | 40 |
| 5 | 15 | 20 | 20 | 20 | 30 | 30 | 40 |
| 4 | 10 | 10 | 10 | 15 | 20 | 25 | 35 |
| 3 | 10 | 0 | 0 | 10 | 15 | 20 | 30 |
| 2 | 10 | 0 | 0 | 10 | 15 | 20 | 25 |
| 1 | 10 | 0 | 0 | 10 | 15 | 20 | 20 |
| 0 | | | | | | | |

ENGINE SPEED (rpm)

AIR-FUEL RATIO CONTROL DEVICE FOR AN INTERNAL COMBUSTION ENGINE

BACKGROUND OF THE INVENTION

1. Field of the Invention

This invention relates to devices for controlling the air-to-fuel ratio supplied to an internal combustion engine to the optimum level at which the torque of the engine is maximized.

2. Description of the Prior Art

Internal combustion engines of the automobiles operating on the Otto cycle are supplied with a mixture of gasoline and air; the mixture is combusted in the cylinders of the engine, and the pressure resulting from the combustion is converted into a torque by a mechanism including a piston and a crankshaft. To obtain maximum torque, the air-to-fuel ratio of the mixture must be controlled to an optimum level. Although the theoretically determined air-to-fuel ratio for obtaining maximum power in an ideal cycle is about 14.6, the optimum air-to-fuel ratio at which the torque is maximized varies with the operating conditions of the engine, such as the rotational speed of the crankshaft and the temperature of the coolant water in the cooling jacket around the cylinders thereof. Thus, to obtain maximum torque under high load conditions, it is necessary to determine the operating conditions of the engine and to control the air-to-fuel ratio supplied to the engine in relationship therewith. In conventional devices, this is usually done by an open-loop control system, as will be described hereinbelow.

FIG. 1 shows the organization of a conventional air-to-fuel ratio control device described in Japanese laid-open patent application No. 60-212643. The flow of air passing an air cleaner 1 is measured by an air flowmeter 2, controlled by a throttle valve 3, and led into an intake manifold 4 to be supplied to each cylinder 5 of the engine. The exhaust gas is led out of the cylinder 5 through an exhaust manifold 6. On the other hand, the fuel, i.e., gasoline, is injected into an air inlet passage to each cylinder 5 by a fuel injection valve 7, in an amount controlled by the control device 8, and the resulting mixture of gasoline and air is supplied into the cylinder 5 to be combusted therein by being ignited by an ignition plug 9. The sensor system for detecting the operating conditions of the engine includes, in addition to the air flowmeter 2 for measuring the amount of air which is supplied to the intake manifold 4 and mixed with the fuel injected therein, a water temperature sensor 10 for detecting the temperature of the coolant water in the cooling jacket around the cylinder 5 of the engine; a crank angle sensor 11 disposed in the distributor in the case of the device shown in the figure; and an exhaust gas sensor 12 for detecting the concentration of a component (e.g. the oxygen concentration) of the exhaust gas. The crank angle sensor 11 generates a reference position pulse at each reference position of an crankshaft (spaced 180 degrees apart in the case of a 4-cylinder engine, 120 degrees in the case of a 6-cylinder engine), and a unit angle pulse each time the crankshaft is rotated a unit angle (e.g. 1 degree). Thus, the crank angle can be determined by counting the number of unit angle pulses generated after a reference position pulse. The rotational speed of the engine, on the other hand, can be determined from the frequency or the period of the unit angle pulses. Thus, the crank angle sensor 11 also functions as a rotational speed detector.

The operation of the control device of FIG. 1 is summarized schematically in FIG. 2. The control device 8, consisting, for example, of a microcomputer including a CPU, a RAM, a ROM, and an input/output interface, computes the appropriate amounts of fuel which are to be injected by the valve 7 on the basis of the signals indicating various values detected by the sensors. The sensors shown at the right hand column of FIG. 2 includes, in addition to those shown in FIG. 1 (i.e., air flowmeter 2, speed detector or the crank angle sensor 11, water temperature sensor 10, and exhaust sensor 9), a throttle total closure switch, a starter motor switch, a battery voltage sensor, etc. The computations of the injected amount of fuel may be divided into two portions. A first portion comprises the computation of the fundamental or the starting injection amount, and the second portion comprises the corrections with respect to various operating conditions, such as the corrections with respect to the battery voltage, high load, etc., and the augumentative corrections for the water temperature and for the time after starting or idling of the engine. Thus, the control device 8 calculates the amount of fuel on the basis of the signals, including the signals S1 through S4, as shown in FIG. 1, outputted by the sensors listed in the right hand column of FIG. 2, and outputs an injection signal S5, in response to which the valve 7 injects a controlled amount of fuel calculated by the control device 8.

To explain the above operation in greater detail, the injection amount of fuel Ti is computed by the control device 8 according, for example, to the following equation:

$$Ti = Tp \times (1 + Ft + KMR/100) \times x\ Ts, \quad (1)$$

where Tp is a fundamental injection amount, and Ft, KMR, $\beta$, and Ts are various correction coefficients as will be explained below. The fundamental injection amount Tp is calculated, for example, by the equation:

$$Tp = K \times Q/N, \quad (2)$$

where Q and N represent the amount of air suction and the rotational speed (i.e., revolutions per minute) of the engine, respectively, K being a constant. The correction coefficient Ft corresponds to the temperature of the coolant water of the engine, and takes, for example, an increasingly greater value as the temperature falls. The coefficient KMR, a correction factor with respect to the high load, is read out of a table of values stored in a memory of the control device 8. As shown in FIG. 3, the values of KMR are stored in a tabulated form according to the fundamental injection amount Tp and the rotational speed of the engine. Further, the battery-voltage correction coefficient Ts compensates for the variation in the operating voltage of the fuel injection valve 7. The correction coefficient $\beta$ is determined on the basis of the exhaust gas concentration signal S4 from the exhaust gas sensor 12. Thus, by multiplying this coefficient $\beta$ in equation (1), the air-to-fuel ratio can be controlled to a predetermined level (e.g., in the neighborhood of the theoretical air-to-fuel ratio 14.6) by means of a feedback control. However, when the feedback control using the signal S4 is effected, the air-to-fuel ratio of the mixture is always controlled to the predetermined constant level, thereby nullifying the effects of the corrections with respect the water coolant temperature and high load. Thus, the feedback control with respect to the exhaust signal S4 is effected only when the coefficients Ft and KMR as described above are equal to zero.

The control device as described above has the following disadvantage: Although feedback control utilizing the signal from the exhaust gas sensor is partially effected, the control system is reduced to an open-loop system without any feedback loop under the high load condition, where the amount of injected fuel Ti is determined by the fundamental injection amount Tp (which in turn is determined by the quantity of air suction Q and the rotational speed N), the rotational speed N, and the battery voltage. Thus, under the high load condition where no feedback loop exists, the random variations in the characteristics of the air flowmeter 2 and the fuel injection valve 7, or the changes in the characteristics thereof with the lapse of time, are not taken into account by the control system. As a result, the air-to-fuel ratio may be deviated from the optimum ratio (i.e., the ratio at which the maximum torque is obtained: this optimum air-to-fuel ratio varies with the operating condition of the engine and is generally different from the target value used in the feedback control with respect to the exhaust gas signal; the optimum ratio generally is, for example, around 13), thereby lowering the torque of the engine and deteriorating the stability thereof. A further disadvantage of the above described control device is this: The air flowmeter 2 measures the quantity of air retained in the air inlet passage, together with that of air which are actually taken into the cylinder 5 of the engine. Thus, even when feedback control is effected, the air-to-fuel ratio is often deviated from the target value thereof.

Thus, the Japanese laid-open patent application No. 60-212643 proposes a control device comprising a means for detecting the pressure within the cylinders of the engine. In the proposed control device, the normalized maximum pressure within a cylinder of the engine (i.e., the ratio of the maximum pressure within a cylinder in the combustion stroke to the pressure therein at the time immediately preceding top dead center), for example, is used as a value for representing the torque generated by the piston in the cylinder; a feedback control is effected to maximize this representative value, e.g. the normalized maximum pressure within the cylinder of the engine. This feedback control proposed by the Japanese patent application represents an improvement over the conventional method. However, the value taken as representative of the torque, e.g., the normalized maximum pressure within the cylinder may not faithfully represent the generated torque. Thus, even by this feedback control, the air-to-fuel ratio may be deviated from the optimum value thereof.

SUMMARY OF THE INVENTION

It is a primary object of this invention, therefore, to provide an air-to-fuel ratio control device for an internal combustion engine which is capable of effecting a feedback control under any operating condition of the engine, so that variations in the characteristics of the sensors for example, may always be compensated for under any operating conditions.

It is an additional object of this invention to provide an air-to-fuel control device for an internal combustion engine which is always capable of controlling the air-to-fuel ratio precisely to the optimum level under any operating condition of the engine.

The engine objects are accomplished in accordance with the principle of this invention in a control device which effects a feedback control of the air-to-fuel ratio on the basis of the relationships which are experimentally established between the values of the air-to-fuel ratio A/F and the values of the ratio, $(dP/d\theta)max/Pmax$, of the maximum rate of change $(dP/d\theta)max$ in pressure P within a cylinder with respect to the crank angle during a predetermined interval of time within a cycle of strokes in the cylinder to the maximum pressure Pmax within the cylinder during the same predetermined interval of time within a cycle. Thus, the pressure P within the cylinder is detected and an actual value of the ratio $(dP/d\theta)max/Pmax$ is computed in each cycle by a feedback value computation means. Further, a target value of the ratio $(dP/d\theta)max/Pmax$ is obtained by converting the optimum air-to-fuel ratio to a value of the ratio $(dP/d\theta)max/Pmax$ by the above-mentioned experimentally established relationship. The optimum air-to-fuel ratio itself is determined by the operating condition of the engine. A feedback control means effects the control of the amount of injected fuel in such a way that the error or the deviation of the actual value of the ratio $(dP/d\theta)max/Pmax$ with respect to the target value thereof is reduced to zero. A feedback value computation means may take an average of the values of the maximum rate of pressure change $(dP/d\theta)max$ within the cylinder in each cycle, and of the maximum pressure Pmax within the cylinder in each cycle during a predetermined period of time or for a predetermined number of cycles, the ratio of the average values of $(dP/d\theta)max$ and Pmax being used instead of the actual ratio $(dP/d\theta)max/Pmax$.

Since the actual value of the ratio $(dP/d\theta)max/Pmax$, which faithfully represents the actual value of air-to-fuel ratio, is controlled to the target value thereof corresponding to the optimum air-to-fuel ratio, the feedback control can be effected under any operating condition of the engine, and the air-to-fuel ratio can be controlled precisely to the optimum level at which the generated torque is the greatest and the stability of the engine is maximized; the variations in the characteristics in the sensors, for example, have no adverse effects on the control of the air-to-fuel ratio.

BRIEF DESCRIPTION OF THE DRAWINGS

The novel features which are believed to be characteristic of this invention are set forth with particularity in the appended claims. This invention itself, however, both as to its organization and method of operation, together with further objects and advantages thereof, may best be understood by reference to the following detailed description, taken in conjunction with the accompanying drawings, in which:

FIG. 3 is a table showing the values of a correction coefficient stored in a memory of the control device of FIG. 1;

FIG. 5 (A) and (B) show the pressure sensor of the control device of FIG. 4 in greater detail, wherein

FIG. 9(*b*) is a flowchart showing the steps followed by a host processor of the control device of FIG. 4, in determining target value of the ratio, $(dP/d\theta)max/Pmax$, and in controlling the amount of injected fuel.

In the drawings, like reference numerals represent like or corresponding portions or parts.

DETAILED DESCRIPTION OF THE PREFERRED EMBODIMENTS

Referring now to FIGS. 4 through 9 of the drawings, an embodiment according to this invention is described.

Figure 1:
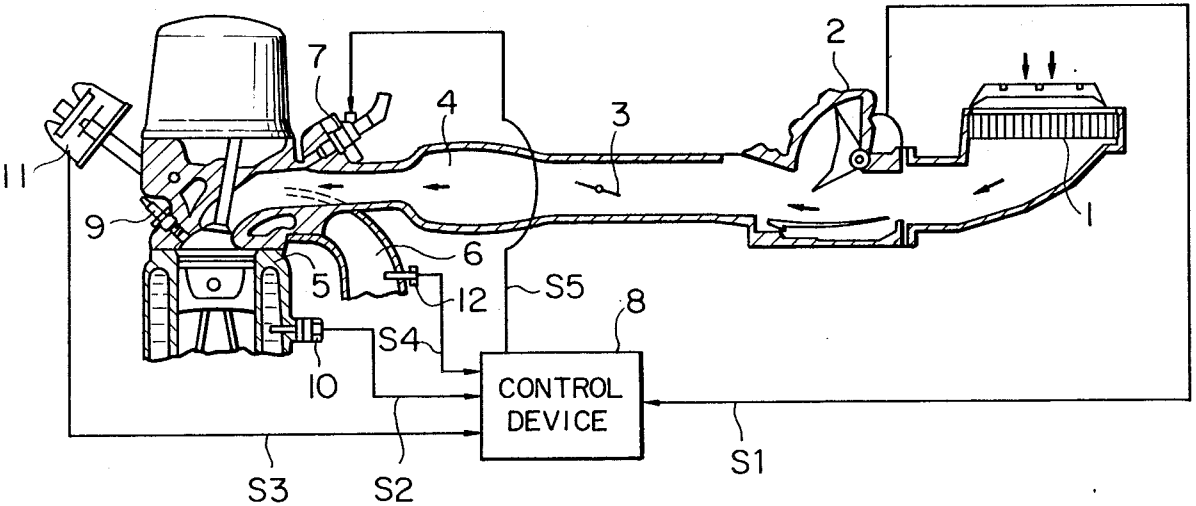
FIG. 1 is a schematic sectional view of the air inlet portion of an internal combustion engine, showing an overall organization of a conventional air-to-fuel ratio control device.
Figure 4:
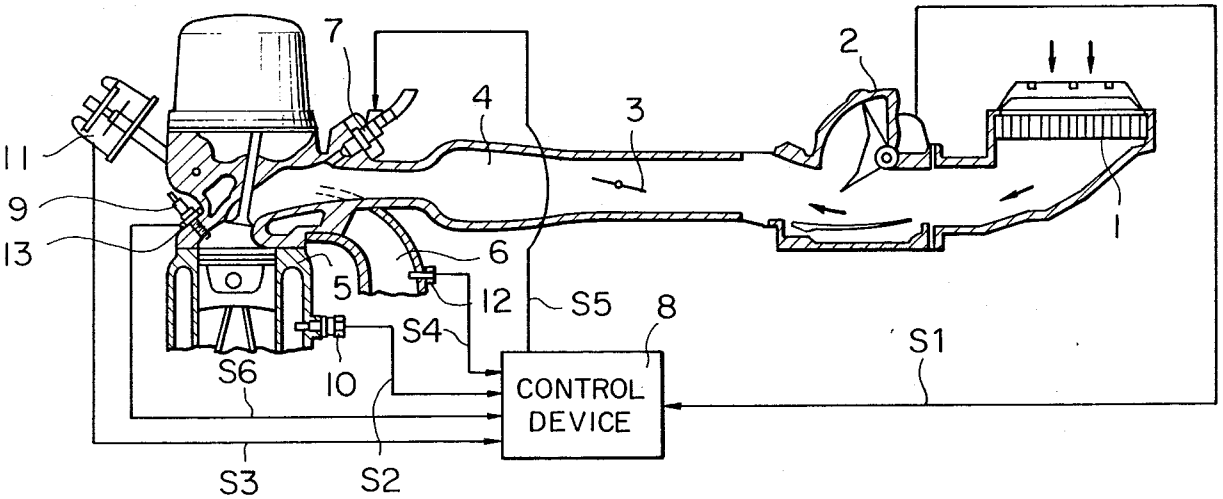
FIG. 4 is a view similar to that of FIG. 1, but showing an overall organization of the control device according to this invention.
Figure 5A:
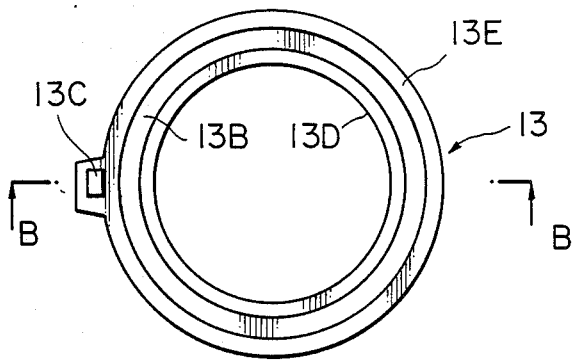
FIG. 5(A) is a top view thereof.
Figure 5B:
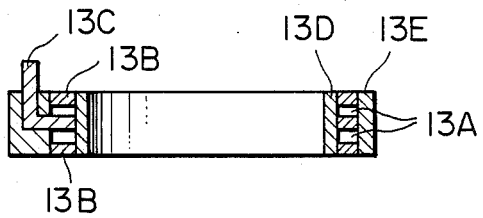
FIG. 5(B) shows a section thereof along the line B—B in FIG. 5(A)
Figure 6:
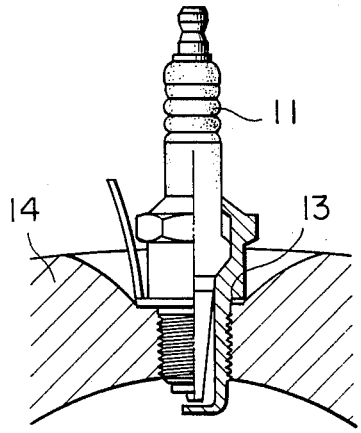
FIG. 6 is a partially sectional view of the base portion of the ignition plug of the engine of FIG. 4, showing the pressure sensor of FIG. 5 (A) and (B) mounted thereat.

FIG. 4 shows the overall organization of the air-to-fuel control device according to this invention. The control system shown in FIG. 4 includes the same sensors which are used in the control system of FIG. 1: an air flowmeter 2 for measuring the quantity of air Q flowing through an air cleaner 1 to an air intake manifold 4, which is controlled by a throttle valve 3; a water temperature sensor 10 for detecting the coolant water temperature in the cooling jacket around the cylinder 5 of the engine; a crank angle sensor 11 for detecting the crank angle of the engine, which, as described above, generates a reference pulse signal at each reference position of a crankshaft and a unit angle pulse at each unit rotational angle of the crankshaft; and an exhaust gas sensor 12 for detecting the concentration of a component (such as the oxygen gas) in the exhaust gas. In addition, the system of FIG. 4 includes a pressure sensor 13, which is disposed at the base of the ignition plug 11, instead of a washer therefor, for detecting the pressure within the cylinder 5 of the engine. As shown in greater detail in FIG. 5, the pressure sensor 13 consists of a pair of annular piezoelectric elements 13A, each of which is held between an axial central positive electrode 13C and a pair of annular negative electrodes 13B disposed at both sides thereof. The piezoelectric elements 13A and the positive and negative electrodes 13C and 13B are accommodated in a cylindrical space formed between an inner and an outer cylindrical casing 13D and 13E. As shown further in FIG. 6, the pressure sensor 13 is tightly secured to the cylinder head 14 by means of the ignition plug 11. Thus, the pressure sensor 13 outputs a voltage across the positive and negative electrodes 13C and 13B which is proportional to the pressure applied to the piezoelectric elements 13A. Since the pressure exerted on the piezoelectric elements 13A corresponds to the pressure within the cylinder 5 of the engine, the output voltage signal S6 of the pressure sensor 13 is proportional to the pressure P within the cylinder 5. The sensors other than the pressure sensor 13 and the engine with its accessary elements are similar to those of FIG. 1 and have like reference numerals; thus, the description thereof is not repeated here.

Figure 7:
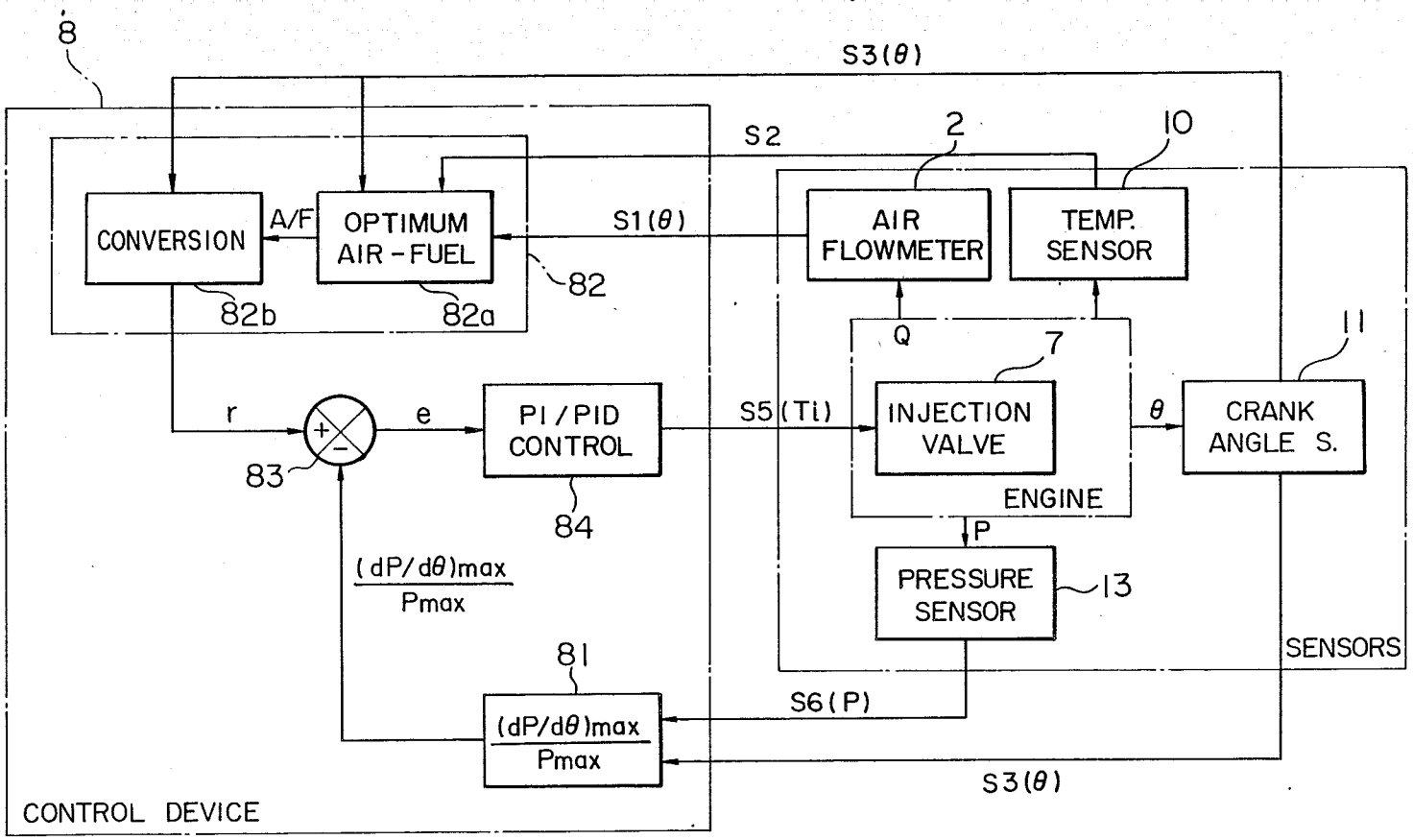
FIG. 7 is a block diagram of the organization of the essential portions of the control device of FIG. 4 in a schematical form, showing the principle of the operation of this invention.
Figure 8:
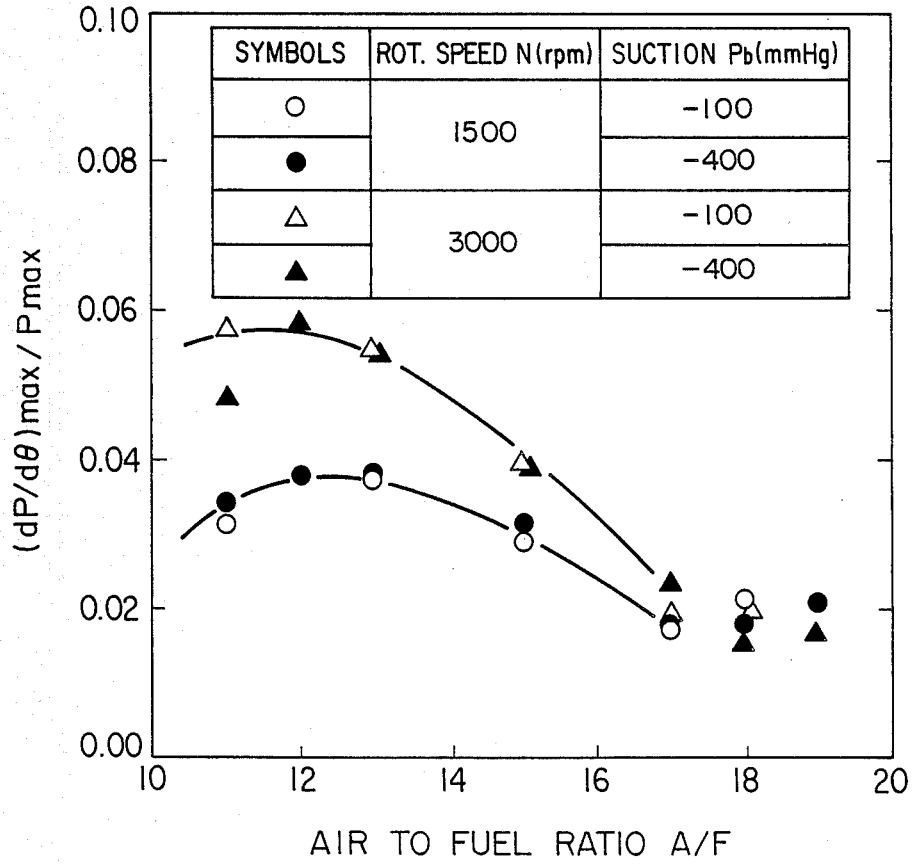
FIG. 8 is a graph showing the relationship between the values of the air-to-fuel ratio A/F and the values of the ratio, $(dP/d\theta)max/Pmax$, which is fundamental to the principle of this invention.

A Control device 8, consisting of a microcomputer, including a CPU constituting a host processor and a coprocessor of data-flow type, as described below, receives output signals from the sensors: an air suction quantity signal S1 from the air flowmeter 2 indicating the quantity of air Q which flows into the intake manifold and, after being mixed with an amount of fuel injected from the fuel injection valve 7, is supplied to the cylinder 5 of the engine; a water temperature signal S2 from the temperature sensor 10 indicating the coolant water temperature in the cooling jacket around the cylinder 5 of the engine; a crank angle signal S3 from the crank angle sensor 11 indicating the reference and the unit angle position of the crankshaft; an exhaust gas signal S4 from the exhaust gas sensor 12 indicating an exhaust gas component concentration; and a pressure signal S6 from the pressure sensor 13 indicating the pressure P within the cylinder 5 of the engine. On the basis of these signals S1 through S4 and S6, the control device 8 computes the amount of fuel Ti which is to be injected by the fuel injection valve 7 during each cycle of the piston in the cylinder 5 of the engine, and outputs an injection signal S5 corresponding thereto; in response to the signal S5 from the control device 8, the injection valve 7 injects an amount of fuel corresponding to the amount Ti computed by the control device 8. The details of the operation of the control device 8 will be described herebelow;

FIG. 7 shows the essential portion of the control system of FIG. 4 which is characteristic of this invention in a schematical form. As shown in the figure, the control device 8 comprises the following computational means or elements: feedback signal computation means 81 for computing the ratio of maximum rate of pressure change within the cylinder to the maximum pressure therein; reference signal computation means 82 for computing the reference value r to which the ratio computed by the computation means 81 is controlled, the reference signal computation means including optimum air-to-fuel ratio computation means 82*a* for computing the optimum air-to-fuel ratio corresponding to the operating condition indicated by the output signals from the sensors, and conversion means 82*b* for converting the optimum air-to-fuel ratio to a value which can be compared to the output of the computation means 81; error computation means 83 for computing the deviation or error e of the ratio computed by means 81 with respect to the reference value r computed by means 82; and PI (proportional plus integral) or PID (proportional plus integral plus derivative) control element 84 for computing the amount of injected fuel Ti on the basis of the error signal e and for outputting the injection signal S5, corresponding to the computed amount Ti, to activate the injection valve 7. The control element 84 controls the amount of injected fuel Ti in such a way that the error e or the deviation of the ratio computed by the means 81, with respect to the reference signal r computed by the means 82 may be reduced to zero, according to the proportional plus integral or proportional plus integral plus derivative control method. By minimizing this error e, the air-to-fuel ratio supplied to the cylinder 5 can indeed be controlled to the optimum level at which maximum torque is generated. The reason therefor and a more detailed description of the operation of the means 81 through 84 of the device 8 are as follows:

FIG. 8 shows the relationship between the air-to-fuel ratio A/F (plotted along the abscissa) and the ratio $(dP/d\theta)max/Pmax$ (plotted along the ordinate) of the maximum rate of pressure change with respect to the crank angle 8, $(dP/d\theta)max/Pmax$, to the maximum pressure Pmax within the cylinder, during a predetermined period of time within each cycle of the engine, e.g., the period of time from the beginning of the compression stroke to the end of the combustion (i.e., the power) stroke of the piston within a cylinder of the engine. As shown in the figure, when the rotational speed N of the engine is fixed, the relationship of the ratio $(dP/d\theta)max/Pmax$ with the air-to-fuel ratio A/F can be faithfully represented by a single curve: so long as the rotational speed N is fixed, the ratio $(dP/d\theta)max/Pmax$ is a function of the air-to-fuel ratio A/F, and the dependency of the ratio $(dP/d\theta)max/Pmax$ on the suction Pb in the air intake passage to the cylinder of the engine is negligible. The fact that the ratio $(dP/d\theta)max/Pmax$ becomes a function of the air-to-fuel ratio and is determined uniquely by the value thereof when the rotational speed is fixed shows that although both quantities $(dP/d\theta)max$ and Pmax depend on the rotational speed and the load of the engine (which is indicated by the suction Pb measured in mmHg in the air intake passage supplying the air to the cylinder 5 of the engine), these quantities $(dP/d\theta)max$ and Pmax depend on the load of the engine in the same proportion, with the result that the ratio $(dP/d\theta)max/Pmax$ thereof does not expressly depend on the load. The results shown in FIG. 8 have been found by repeated experiments and are fundamental to the principle of this invention. Namely, the conversion means **82*b* of the reference signal computation means 82 determines the reference value r from the optimum air-to-fuel ratio determined by the optimum air-to-fuel ratio computation means 82*a* on the basis of the relationship shown in FIG. 8**, as described below.

Figure 2:
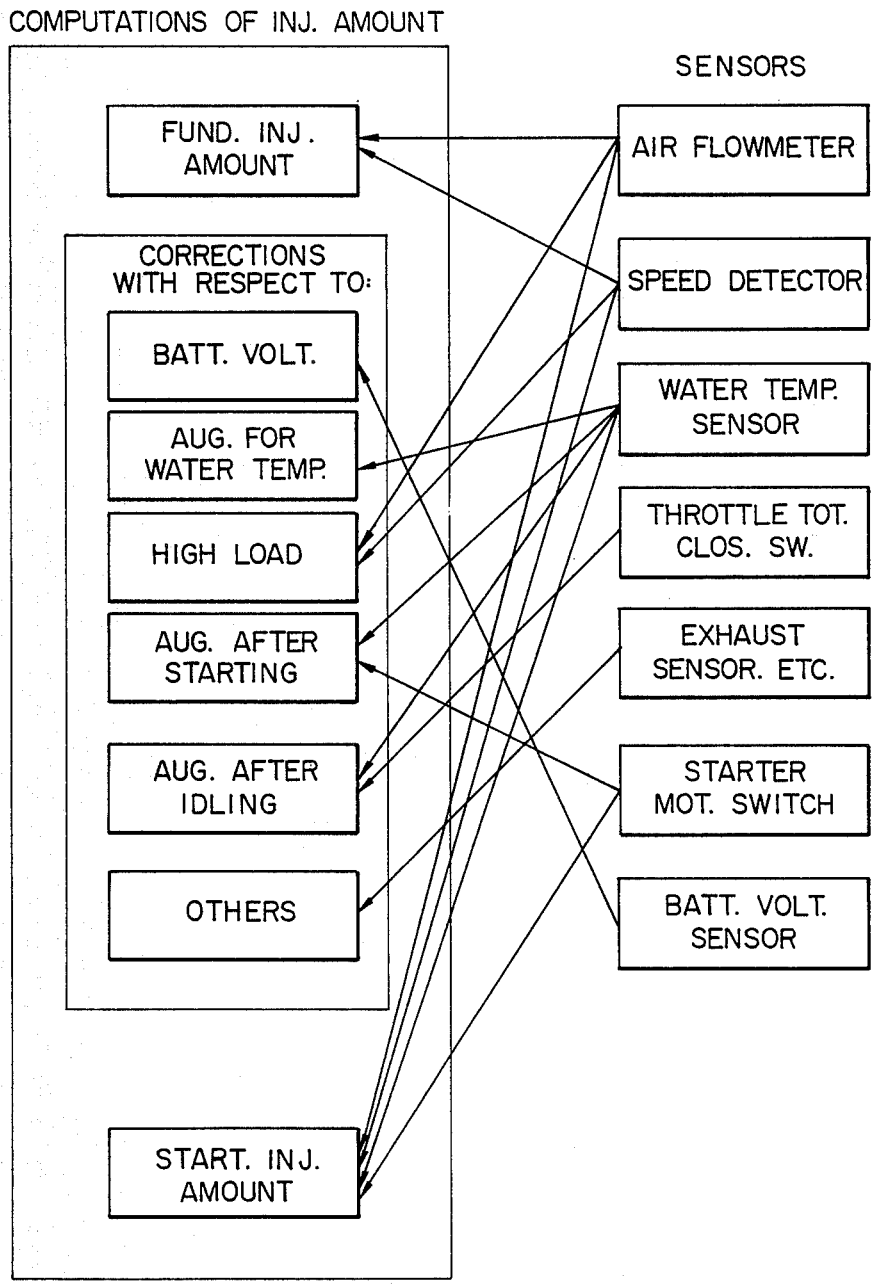
FIG. 2 is a diagram showing the relationship between the outputs of sensors and the computations of the fuel injection amount effected by the control device of FIG. 1.

Thus, the operation of the reference signal computation means 82 is as follows: first, the optimum air-to-fuel ratio computation means **82*a* determines the optimum air-to-fuel ratio A/F corresponding to the operating condition of the engine such as the rotational speed N and the quantity of air Q supplied thereto. As mentioned above, the optimum air-to-fuel ratio is the ratio at which the generated torque and the stability of the engine is maximized. The optimum air-to-fuel ratio computation means 82*a* receives signals such as an air suction quantity signal S1, a water temperature signal S2, and a crank angle signal S3, from the air flowmeter 2, water temperature sensor 10, and the crank angle sensor 11, respectively, and determines the operating condition of the engine corresponding to these signals. The operating condition of the engine is determined, for example, by such variables as the rotational speed N (which is measured in revolutions per minute and can be computed from the period or frequency of the unit angle pulse signal contained in the signal S3 outputted from the crank angle sensor 11), the quantity of air flow Q or the suction Pb in the air intake passage, and the temperature of the coolant water within the cooling jacket around the cylinder 5 of the engine. In this connection, other variables may be used in addition to these variables, in a way analogous to that shown schematically in FIG. 2, in determining the operating condition of the engine; conversely, the number of variables determining the operating condition may be reduced by omitting, for example, the temperature of the coolant water. Further, the computation means 82*a* computes the optimum air-to-fuel ratio A/F corresponding to the thus determined operating condition using an equation similar to the equation (1) above. Alternatively, the computation means 82*a* comprises a memory in which the values of the optimum air-to-fuel ratio are stored in a tabular form as a function of the operating condition of the engine, and determines the optimum air-to-fuel ratio A/F by looking up the value corresponding to the operating condition. On the other hand, the conversion means 82*b* determines the reference value r from the air-to-fuel ratio A/F by means of the relationship between the ratio A/F and the ratio $(dP/d\theta)max/Pmax$ described above. Namely, the conversion means 82*b* comprises a memory in which the relationships between the ratio A/F and the ratio $(dP/d\theta)max/Pmax$ as shown in FIG. 8 are stored according to each value of the rotational speed N of the engine. Thus, the conversion means 82*b*, after computing the rotational speed N of the engine from the unit angle pulse signal contained in the crank angle signal S3 outputted from the crank angle sensor 11, determines the value of the ratio $(dP/d\theta)max/Pmax$ which corresponds to the ratio A/F (outputted from the computation means 82*a*) at the rotational speed N which has been just computed. The conversion means 82*b* outputs this value of the ratio $(dP/d\theta)max/Pmax$ as the reference value r to the error computation means 83. Thus, the value r outputted from the conversion means 82*b*** represents the target value of the ratio $(dP/d\theta)max/Pmax$. The air-to-fuel ratio is at the optimum level when the ratio $(dP/d\theta)max/Pmax$ agrees with the reference value r.

The feedback value computation means 81, on the other hand, computes the actual value of the ratio $(dP/d\theta)max/Pmax$ in each cycle of the piston in the cylinder 5, from the values of pressure P and the angle: the values of the pressure P within the cylinder indicated by the signal S6 from the pressure sensor 13, and the values of the crank angle $\theta$ indicated by the signal S3 from the crank angle sensor 11. Namely, during a predetermined period of time in each cycle, e.g., from the beginning of the compression stroke to the end of the combustion stroke, the computation means 81 computes the rate of change of the pressure P with respect to crank angle $\theta$, $dP/d\theta$, and determines the maximum value thereof $(dP/d\theta)max$. The computation means 81 also determines the maximum pressure Pmax within the cylinder 5 during the same period of time, and computes the ratio $(dP/d\theta)max/Pmax$ from these two values of $(dP/d\theta)max$ and Pmax. This is the principle of the operation of the computation means 81. In practice, however, the rate of change of pressure, $dP/d\theta$, is replaced by a finite rate of change of pressure. $\Delta P/\Delta\theta$. Thus, in the case where the crank angle sensor 11 outputs a unit angle pulse signal each time as the crank is rotated one degree, the increment of pressure $\Delta P$ in an interval between two succeeding unit angle pulses is equal to the finite rate of change of pressure $\Delta P/\Delta\theta$, since the equation $\Delta P/\Delta\theta = \Delta P/1$ holds. Thus, in such a case, the computation means 81 computes the increment of pressure $\Delta P$, and selects the maximum value $\Delta Pmax$ among the values thereof computed during the predetermined period in each cycle. In this case, the ratio $\Delta Pmax$-

/Pmax is used instead of the ratio (dP/dθ)max/Pmax. On the other hand, in the case where the crank angle sensor 11 outputs unit angle pulses each of which is separated from the preceeding pulse by two degrees, the increment ΔP in the interval between two succeeding unit angle pulses is divided by 2 to obtain the finite rate of pressure change, since in that case the equation $\Delta P/2=\Delta P/\Delta\theta$ holds. In such a case, the ratio ΔPmax/2Pmax is computed by the means 81 and is used instead of the ratio (dP/dθ)max/Pmax.

Further, in the case where the rotational speed N of the engine does not change and the value thereof is known, the rate of change of pressure P with respect to crank angle θ, dP/dθ, can be determined from the rate of change of pressure P with respect to time t, dP/dt, using the approximate relationship d=6N dt:

$$dP/d\theta=(dP/dt)6N, \quad (3)$$

Thus, by means of the equation (3) above, the computation means 81 can compute the ratio (dP/dθ)max/Pmax=(dP/dt)max/Pmax·6N without using the crank angle signal S3 indicating the crank angle θ. As a result, the control device 8 is capable of controlling the air-to-fuel ratio not only under the high load condition, but also during the transient time when, for example, the accelerator pedal is activated.

The error computation means 83 computes the error e or the deviation of the actual ratio (dP/dθ)max/Pmax computed and outputted from the means 81, with respect to the reference or target value r outputted from the conversion means **82*b* of the reference signal computation means 82. Namely, the error computation means 83, consisting of a subtractor circuit, computes the difference e (which is the error e outputted from the means 83**) by means of the following equation:

$$e=r-(dP/d\theta)\text{max}/P\text{max}, \quad (4)$$

where the ratio (dP/dθ)max/Pmax in the righthand side is the actual value computed by the computation means 81.

The control element 84 controls the amount of fuel Ti injected through the injection valve 7 to reduce the error e on the proportional plus integral (PI) action. Namely, the increment ΔTi of the amount of fuel Ti is proportional to the error e and its integral over a period of time. Alternatively, the control element 84 controls the amount of injected fuel Ti on the proportional plus integral plus derivative (PID) action, in which the increment ΔTi of the injected amount Ti is a linear combination of error e, its integral, and its derivative. Since these control methods are well known, further description thereof is deemed unnecessary.

In the above embodiment, the ratio (dP/dθ)max/Pmax computed by the feedback value computation means 81 during each cycle of the engine is compared directly with a target value thereof, i.e., the reference value r outputted from the reference value computation means 82. However, the feedback value computation means 81 may comprise means for taking an average of a number of values of the maximum rate of pressure change (dP/dθ)max and the maximum pressure Pmax, during a predetermined period of time or during a predetermined number of cycles, the feedback value computation means 81 outputting the ratio of these two average values of the maximum rate of pressure change (dP/dθ)max and the maximum pressure Pmax. In such a case, the error e computed by the error computation means 83 is expressed by the following equation:

$$e=r-(\text{average of } (dP/d\theta)\text{max})/(\text{average of } P\text{max}), \quad (5)$$

and control element 84 controls the amount of injected fuel Ti to reduce this error e.

The above description of the operation of the control device 8 in reference to FIG. 7 has been primarily concerned with the principle of the operation thereof. In what follows, the actual steps followed by the microcomputer constituting the control device 8 are described in greater detail. The steps described below are an example of the following case: the crank angle sensor 11 outputs unit angle pulses at the interval of one degree; the above mentioned ratio (dP/dθ)max/Pmax is determined for each cycle of the piston in a cylinder during the time period from the beginning of the compression stroke to the end of the combustion stroke; and the microcomputer constituting the control device 8 comprises a host processor and a coprocessor of data-flow type, wherein the main routine (shown in FIG. 9(*b*)) in the host processor executes the functions of the reference signal computation means 82, the error computation means 83, and the control element 84, while the subroutine (shown in FIG. 9(a)) in the coprocessor executes the function of the computation means 81. Further, the error e is computed by the equation (4) above, not by the equation (5): the feedback value computation means does not comprise means for taking average values of the maximum rate of pressure change (dP/dθ)max and the maximum pressure Pmax determined in each cycle.

Figure 9A:
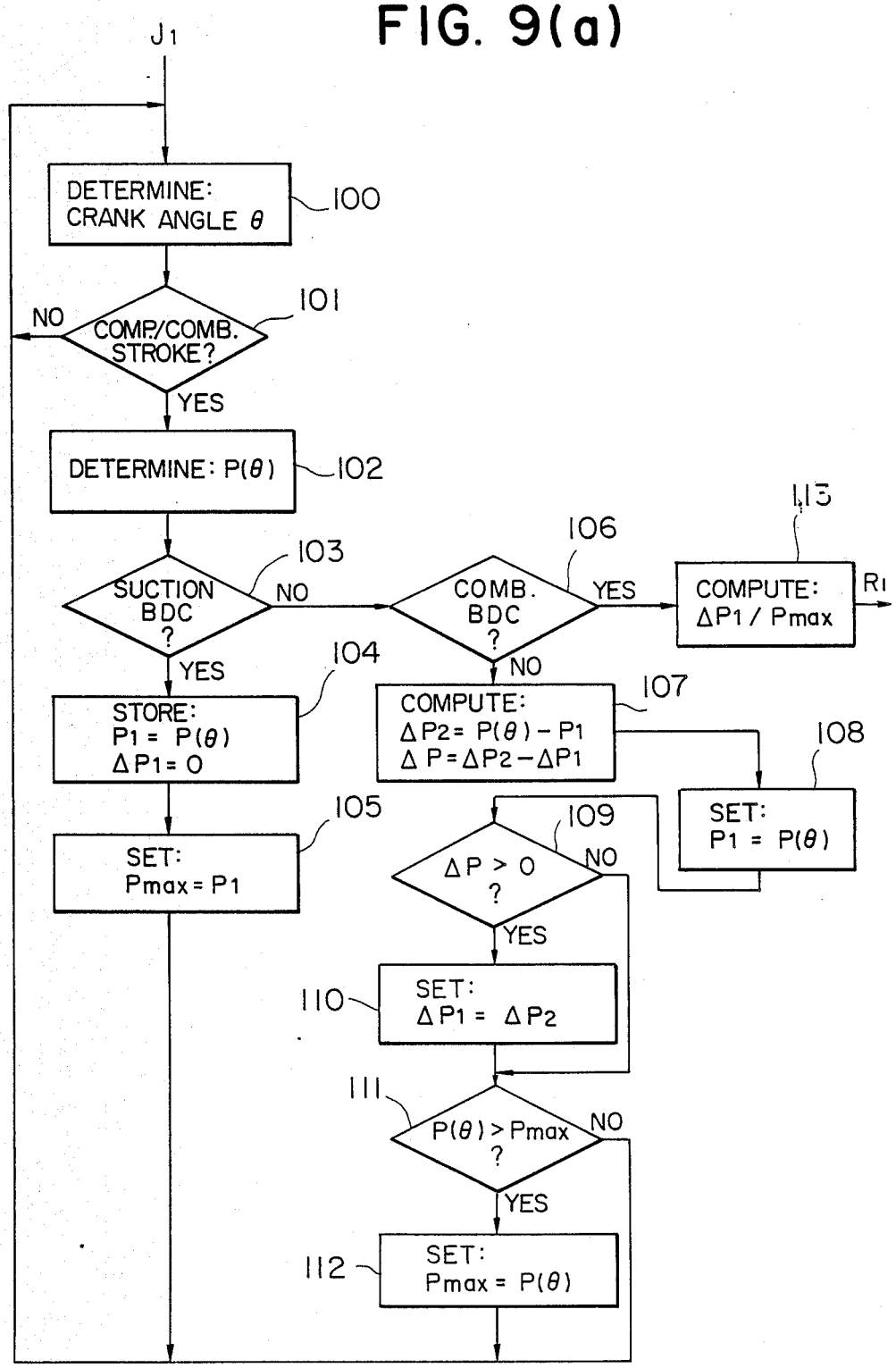
FIG. 9(*a*) is a flowchart showing the steps followed by a coprocessor of the control device of FIG. 4, in determining the actual value of the ratio, $(dP/d\theta)max/Pmax$.
Figure 9B:
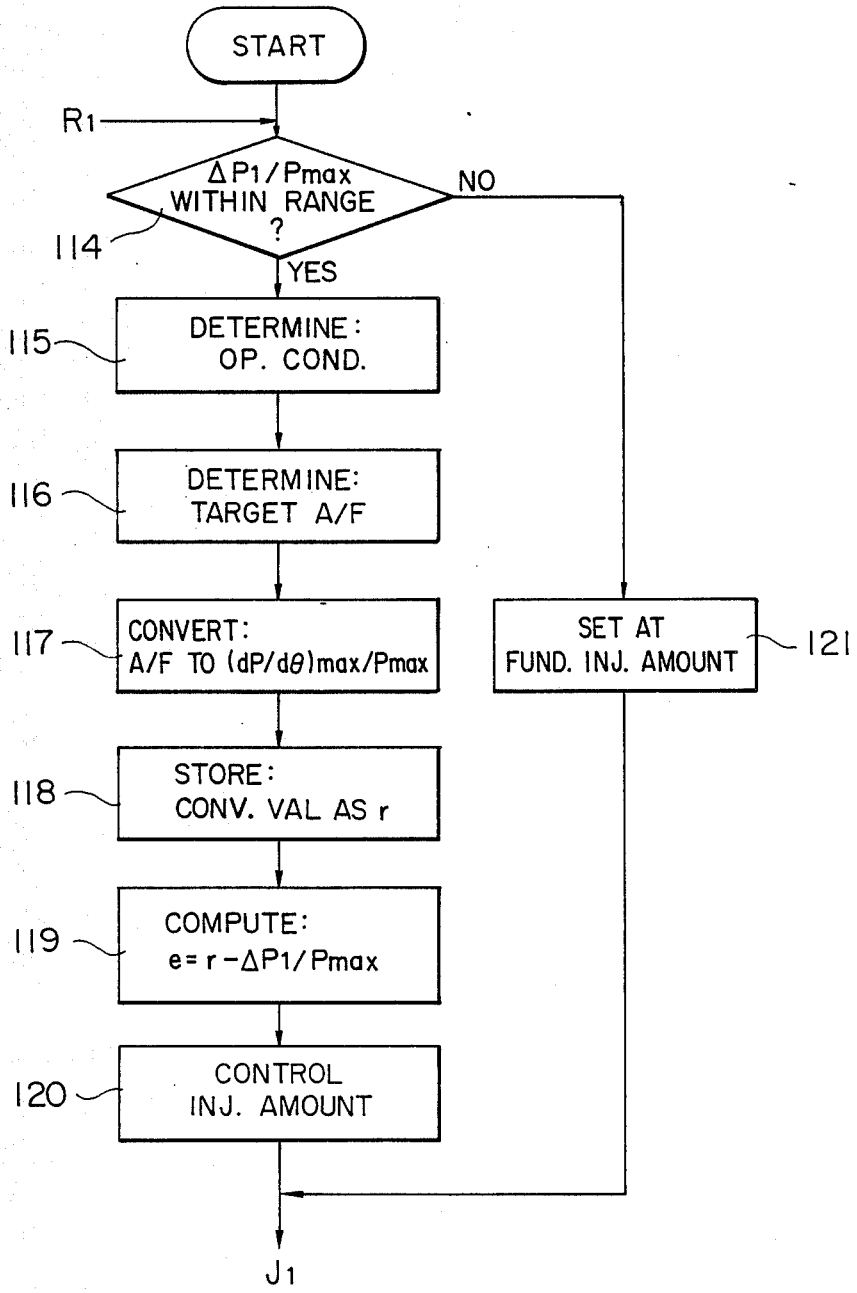

FIG. 9(*a*) shows an example of the steps followed by the subroutine in the coprocessor constituting the computation means 81 described above, in determining the ratio (dP/dθ)max/Pmax. Thus, when the execution of the program in the microcomputer runs into the subroutine shown in FIG. 9(*a*), the following steps are performed.

At step 100, the crank angle θ, which is determined by counting the number of unit angle pulses generated after a reference pulse signal in the signal S3 outputted from the crank angle sensor 11, is registered. At step 101, judgement is made whether the crank angle θ determined at the previous step 100 belongs to the compression or the combustion (i.e., the power) stroke, or not. If it is judged that the angle θ is in fact in the compression or the combustion stroke, the pressure P(θ) within the cylinder 5 indicated by the signal S6 from the pressure sensor 13 is determined and registered at step 102. If, on the other hand, the judgement at step 101 is in the negative, the execution of the program returns to step 100 and the next unit angle pulse from the crank angle sensor 11 is waited.

At step 103 subsequent to step 102, judgement is made whether the crank angle θ determined at the previous step 100 is at the bottom dead center at the end of the suction stroke (i.e., at the beginning of the compression stroke). If the judgement is in the affirmative, the pressure P(θ) determined at the previous step 102 and the value zero are stored as the values of the variables P1 and ΔP1 in the memory at the next step 104; namely, $$P1=P(\theta),$$

and $\Delta P1=0$

At the next step 105, the value of P1 which is stored at the previous step 104 is stored as the initial value of the variable Pmax; namely, $$Pmax=P1,$$

and the program returns to the step 100.

When, on the other hand, the judgement at step 103 is in the negative, judgement is made whether the crank angle $\theta$ is at the bottom dead center at the end of the combustion stroke, or not, at step 106. If the judgement is in the negative at step 106 (this only occurs in the case in which the crank angle $\theta$ determined at the preceeding step 100 belongs to the compression or the combustion stroke, the bottom dead centers at the beginning of the compression stroke and at the end of the combustion stroke being excluded), the execution of the program runs into step 107 where the values, $$\Delta P2=P(\theta)-P1,$$

and $$\Delta P=\Delta P2-\Delta P1,$$

are computed and registered. At the next step 108, the value of the variable P1 is renewed; namely, the pressure $P(\theta)$ determined and registered at the preceeding step 102 is stored as the value of the variable P1. Then, at steps 109 and 110, the value of the variable $\Delta$P1 is renewed, if necessary, so that it will represent the greatest increment $\Delta P$ in the interval between the two succeeding unit angle pulses in the signal S3 after the beginning of the compression stroke. Namely, at step 109, it is judged whether the variable $\Delta P$ computed at the previous step 107 is positive or not. If the judgement at step 107 is in the affirmative, i.e., if $\Delta$P2 is greater than $\Delta$P1, the value of the variable P1 is renewed, i.e., the new value of $\Delta$P2 computed at the preceeding step 107 is stored as the value of the variable at step 110. On the other hand, if the judgement at step 109 is in the negative, the value of the variable $\Delta$P1 is not renewed, and the program goes to steps 111 and 112 where the maximum pressure Pmax within the cylinder is renewed. Namely, judgement is made whether $P(\theta)$ determined and registered at the preceeding step 102 is greater than the value of Pmax or not, and if the judgement is in the affirmative at step 111, the value of Pmax is renewed, i.e., the value of $P(\theta)$determined at the preceeding step 102 is stored as the new value of Pmax. If, on the other hand, the judgement at step 111 is in the negative, the program returns to step 100 without renewing the value of Pmax.

Thus, by repeating the steps 100 through 103 and the steps 106 through 112, an approximate value of the maximum rate of pressure change within the cylinder 5 of the engine during the period of time after the beginning of the compression stroke to the end of the combustion stroke in each cycle of the piston, $(dP/d\theta)max$, is obtained as the last value of $\Delta$P1; the maximum pressure within the cylinder 5 during the same period of time in each cycle is obtained as the value of Pmax. Thus, when the judgement at step 106 is finally in the affirmative at the end of the combustion stroke in a cycle, the ratio $\Delta$P1/Pmax of the latest values of the variables $\Delta$P1 and Pmax stored at the steps 110 and 112, respectively, is computed at step 113, and the execution of the program returns to the host processor.

By the way, the execution of the steps 100 through 103 and the steps 106 through 112 must be completed in the interval of time in which the crankshaft rotates one degree. Thus, as mentioned above, it is preferred that the subroutine shown in FIG. 9(*a*) be performed by a data-flow type coprocessor. Since the data-flow type processor automatically executes a program when necessary data for the program is supplied, the host processor, governing the functions of the means 82 through 84 in the control device 8, may control the running of the subroutine of FIG. 9(*a*) by the coprocessor in the following manner. Namely, when the crank angle signal S3 is inputted, the host processor, which may be an ordinary von Neumann type computer and governs the overall operation of the control device 8, transmits the data of the crank angle $\theta$ and the pressure $P(\theta)$ within the cylinder at that instant to the coprocessor. The data-flow type coprocessor, in which the program for executing the steps shown in FIG. 9(*a*) is stored, automatically begins to execute the steps thereof. When, on the other hand, the subroutine of FIG. 9(*a*) ends at step 113, the coprocessor outputs the value $\Delta$P1/Pmax computed at step 113 to the host processor, which, in response thereto, begins to execute the steps shown in FIG. 9(*b*).

However, it is possible to use an independently operating data-flow type processor as a host processor. In such a case, the host processor may be used for executing the subroutine shown in FIG. 9(*a*), as well as the steps shown in FIG. 9(*b*) described below. Alternatively, the maximum rate of pressure change $(dP/d\theta)max$ and the maximum pressure Pmax may be determined by an analog circuit, such as the peak value holding circuit, instead of by a program.

It is noted in passing that the steps of FIG. 9(*a*) may easily be modified, as described above in connection with the operation of the feedback value computation means 81, for the case where the pressure $P(\theta)$ is sampled at the interval of two degrees or more of the crank angle $\theta$. Specifically, when the revolutions per minute of the crankshaft of the engine exceeds 3000, for example, it may become difficult even for a data-flow type processor to execute the whole cycle of steps 100 through 103 and 106 through 112 in an interval of one degree of the crank angle. Thus, the pressure $P(\theta)$ may be sampled at the interval of two degrees. In such a case, the values of the variable $\Delta$P1, $\Delta$P2 and $\Delta P$ at steps 107, 109 and 110 must only be replaced by the values thereof divided by two, i.e., the sampling interval of the crank angle.

FIG. 9(*b*) shows the steps followed by the host processor effecting the functions of means 82 through 84 of the control device 8. When the value of $\Delta$P1/Pmax is outputted from the coprocessor executing the subroutine of FIG. 9(*a*), the host processor judges, at step 114, whether the value $\Delta$P1/Pmax is within a predetermined range or not. If the judgement at step 114 is in the negative, the amount of injected fuel Ti is set at the fundamental injection amount Tp which may be calculated, for example, by the equation (2), and an injection signal S5 corresponding thereto is outputted at step 121. Thus, in such a case, no feedback control is effected. On the other hand, when the judgement at step 114 is in the affirmative, the optimum air-to-fuel ratio A/F corresponding to the operating condition of the engine is determined at steps 115 and 116. Namely, at step 115, the operating condition of the engine is determined from the rotational speed N of the engine and the amount of air supply Q (or the suction or the negative pressure Pb in the air intake passage supplying air to the cylinder 5), and at step 116, the optimum or target air-to-fuel ratio A/F corresponding to the operating condition determined at the preceeding step 115 is determined by looking up the value thereof in the table stored in the memory. The steps 115 and 116 correspond to the function of the optimum air-to-fuel ratio computation means 82*a* described above. At the next step 117, which corresponds to the function of the conversion means 82*b* as described above, the optimum ratio A/F is converted into a corresponding value of the ratio (dP/d$\theta$) max/Pmax, which can be compared to P1/Pmax, utilizing the relationships shown in FIG. 8, and the value obtained by the conversion at step 117 is stored as the value of the reference value r at the step 118. Next, at step 119, which corresponds to the function of the error computation means 83, the error e is computed by the equation:

$$e=r-\Delta P1$$

At the final step 120, which corresponds to the function of the control element 84, the amount of injected fuel Ti is controlled by means of the proportional plus integral or the proportional plus integral plus derivative control method. When the injection signal S5 indicating the amount of fuel Ti determined at step 120 is outputted, the host processor begins to supply the crank angle $\theta$ and the pressure P to the coprocessor. The coprocessor, in response thereto, begins to execute the subroutine of FIG. 9(*a*).

While description has been made of a particular embodiment according to this invention, it will be understood that many modifications may be made without departing from the spirit thereof. For example, although the pressure sensor of the above described embodiment measures the value of the pressure P within the cylinder, a sensor which is capable of measuring the rate of change of the pressure P can be used instead, in which case the above described operations of the control device can be effected more easily. The appended claims are contemplated to cover any such modifications as fall within the true spirit and scope of this invention.

What is claimed is:

1. A control device for controlling an air-to-fuel ratio of a mixture of fuel and air supplied to an internal combustion engine, comprising:

air quantity detecting means for measuring a quantity of air supplied to said internal combustion engine;

crank angle sensor means for detecting a crank angle ($\theta$) of said internal combustion engine;

pressure sensor means for detecting a pressure (P) within a cylinder of said internal combustion engine;

feedback value computation means, coupled to outputs of said pressure sensor means and said crank angle sensor means, for computing an actual ratio of a maximum rate of pressure change (dP/d$\theta$)max within said cylinder with respect to said crank angle during a predetermined interval of time within a cycle of strokes in said cylinder to a maximum pressure (Pmax) within said cylinder during the same predetermined interval of time within a cycle of strokes in said cylinder;

optimum air-to-fuel ratio computation means, coupled to outputs of said air quantity detecting means and said crank angle sensor means, for determining an optimum air-to-fuel ratio corresponding to an operating condition of said internal combustion engine determined by parameters including said outputs of said air quantity detecting means and said crank angle sensor means;

conversion means, coupled to an output of said optimum air-to-fuel ratio computation means, for determining a value of a target ratio of the maximum rate of pressure change (dP/d$\theta$)max within said cylinder with respect to said crank angle during said predetermined interval of time within a cycle of strokes in said cylinder to the maximum pressure (Pmax) within said cylinder during the same predetermined interval of time within a cycle of strokes in said cylinder by means of a relationship between values of air-to-fuel ratio and values of said ratio of the maximum rate of pressure change (dP/d$\theta$)max within said cylinder with respect to the crank angle during said predetermined interval of time to the maximum pressure (Pmax) within said cylinder during the same predetermined interval of time within a cycle of strokes in said cylinder, said target ratio corresponding to said optimum air-to-fuel ratio determined by said optimum air-to-fuel ratio computation means;

error computation means, coupled to said feedback value computation means and said conversion means, for computing a deviation of said actual ratio, computed by said feedback value computation means, with respect to said target value determined by said conversion means;

fuel injection means for injecting an amount of fuel into an air intake passage coupled to said cylinder of the internal combustion engine; and control means, coupled to an output of said error computation means, for controlling said amount of fuel injected by said fuel injection means to reduce said deviation, outputted from said error computation means, of said actual ratio with respect to said target ratio.

2. A control device as claimed in claim 1, wherein said conversion means comprises rotational speed determining means, coupled to an output of said crank angle sensor means, for determining a rotational speed of a crankshaft of said internal combustion engine, and said relationship, used by said conversion means in determining said target value, determines a unique value of said target ratio according to a value of the rotational speed of the crankshaft of said internal combustion engine determined by said rotational speed determining means.

3. A control device as claimed in claim 1, wherein said optimum air-to-fuel ratio computation means comprises rotational speed determining means, coupled to an output of said crank angle sensor means, for determining a rotational speed of a crankshaft of said internal combustion engine, said operating condition of the internal combustion engine being determined by parameters including the rotational speed of the crankshaft of said internal combustion engine.

4. A control device as claimed in claim 1, wherein said crank angle sensor means comprises means for generating unit angle pulses at a predetermined interval of the crank angle ($\Delta\theta$), and said feedback value computation means comprises means for computing an increment ($\Delta P$) of pressure (P) within said cylinder in an interval ($n \cdot \Delta\theta$)between two pulses separated by a predetermined number (n) of said predetermined interval of crank angle ($\Delta\theta$) so that a finite rate of pressure change ($\Delta P/n \cdot \Delta \downarrow$) in said cylinder with respect to the crank angle in an interval ($n \cdot \Delta\theta$) between two pulses separated by said predetermined number (n) of said predetermined interval of crank angle ($\Delta\theta$) is used instead of a rate of change of pressure within said cylinder ($dP/d\theta$) a maximum finite rate of pressure change ($\Delta P/n \cdot \Delta\theta$)max within said cylinder with respect to the crank angle during said predetermined interval of time within a cycle of strokes in said cylinder being used instead of the maximum rate of pressure change ($dP/d\theta$)max within said cylinder with respect to the crank angle during the same predetermined interval of time within a cycle of strokes in said cylinder.

5. A control device as claimed in claim 4, wherein said predetermined interval of crank angle ($\Delta\theta$), at which said unit angle pulses are generated by said means for generating unit angle pulses in said angle sensor means, is equal to one degree, and said predetermined number (n) is equal to one, so that the increment ($\Delta P$) in pressure (P) in said cylinder in said predetermined interval of crank angle ($\Delta\theta$) is used instead of a rate of change of pressure ($dP/d\theta$) within said cylinder, a maximum increment ($\Delta P$max) in pressure (P) within said cylinder with respect to the crank angle during said predetermined interval of time within a cycle of strokes in said cylinder being used instead of the maximum rate of pressure change ($dP/d\theta$)max within said cylinder during the same predetermined interval of time within a cycle of strokes in said cylinder.

6. A control device as claimed in claim 1, wherein said air quantity detecting means comprises an air flowmeter disposed at an air intake passage coupled to said cylinder of the internal combustion engine.

7. A control device as claimed in claim 1, wherein said pressure sensor means comprises a piezoelectric element disposed at a base portion of an ignition plug of said cylinder of internal combustion engine, and a pair of electrodes holding said piezoelectric element therebetween, said pair of electrodes outputting a voltage thereacross which corresponds to said pressure within said cylinder of the internal combustion engine.

8. A control device as claimed in claim 1, wherein said control means controls said amount of fuel injected by said fuel injection means according to a proportional plus integral control action on a basis of said deviation computed by said error computation means.

9. A control device as claimed in claim 1, wherein said control means controls said amount of fuel injected by said fuel injection means according to a proportional plus integral plus derivative control action on a basis of said deviation computed by said error computation means.

10. A control device as claimed in claim 1, wherein said predetermined interval of time within a cycle of strokes in said cylinder comprises an interval of time from the beginning of a compression stroke to the end of a combustion stroke in said cylinder within a cycle of four strokes in said cylinder.

11. A control device as claimed in claim 1, wherein said control device comprises a microcomputer for effecting functions of said feedback value computation means, said optimum air-to-fuel ratio computation means, said conversion means, said error computation means, and said control means.

12. A control device as claimed in claim 11, wherein said microcomputer comprises a host processor and a coprocessor of data-flow type, said coprocessor having stored therein a program for computing, in each cycle of strokes in said cylinder, an actual ratio of a maximum rate of pressure change ($dP/d\theta$)max within said cylinder with respect to said crank angle during a predetermined interval of time within the cycle of strokes in said cylinder to a maximum pressure (Pmax) within said cylinder during the same predetermined interval of time within the cycle of strokes in said cylinder, the host processor governing functions of said optimum air-to-fuel ratio computation means, said conversion means, said error computation means, and said control element.

13. A control device as claimed in claim 12, wherein said crank angle sensor means comprises means for generating unit angle pulses at a predetermined interval of the crank angle ($\Delta\theta$), and said coprocessor comprises a subroutine for computing a increment ($\Delta P$) of pressure (P) within said cylinder in an interval ($n \cdot \Delta\theta$) between two pulses separated by a predetermined number (n) of said predetermined interval of crank angle ($\Delta\theta$), and a finite rate of pressure change ($\Delta P/n \cdot \Delta\theta$) in said cylinder with respect to the crank angle in an interval ($n \cdot \Delta\theta$) between two pulses separated by said predetermined number (n) of said predetermined interval of crank angle ($\Delta\theta$) is computed as an approximate value of a rate of change of pressure within said cylinder ($dP/d\theta$), a maximum finite rate of pressure change ($\Delta P/n \cdot \Delta\theta$)max within said cylinder with respect to the crank angle during said predetermined interval of time within a cycle of strokes in said cylinder being computed as an approximate value of the maximum rate of pressure change ($dP/d\theta$)max within said cylinder with respect to the crank angle during the same predetermined interval of time within a cycle of strokes in said cylinder.

14. A control device as claimed in claim 13, wherein said predetermined interval of crank angle ($\Delta\theta$) at which said unit angle pulses are generated by said means for generating unit angle pulses in said angle sensor means, is equal to one degree, and said predetermined number (n) is equal to one, so that the increment ($\Delta P$) in pressure (P) in said cylinder in said predetermined interval of crank angle ($\Delta\theta$) is computed as the approximate value of the rate of change of pressure within said cylinder ($dP/d\theta$), the maximum increment ($\Delta P$max) in pressure (P) within said cylinder with respect to the crank angle during said predetermined interval of time within a cycle of strokes in said cylinder being computed as the approximate value of the maximum rate of pressure change ($dP/d\theta$)max within said cylinder during the same predetermined interval of time within a cycle of strokes in said cylinder.

15. A control device as claimed in claim 1, wherein said feedback value computation means comprises first means for taking an average of a number of values of said maximum rate of pressure change ($dP/d\theta$)max within cylinder during said predetermined interval of time within a cycle of strokes, and second means for taking an average of a number of values of the maximum pressure (Pmax) within said cylinder during said predetermined interval of time in a cycle of strokes, said feedback value computation means computing and outputting a ratio of the average of said maximum pressure change ($dP/d\theta$)max and the average of maximum pressure (Pmax), as said actual ratio computed by said feedback value computation means.

16. A control device as claimed in claim 15, wherein said first and second means take the averages of a number of values of said maximum rate of pressure change (dP/dθ)max and said maximum pressure (Pmax) for a predetermined number of strokes in said cylinder of the internal combustion engine.

17. A control device as claimed in claim 15, wherein said first and second means take the averages of a number of values of said maximum rate of pressure change (dP/dθ)max and said maximum pressure (Pmax) for a predetermined period of time.

* * * * *

UNITED STATES PATENT AND TRADEMARK OFFICE

CERTIFICATE OF CORRECTION

PATENT NO. : 4,928,653

DATED : May 29, 1990

INVENTOR(S) : Ohkubo et al.

It is certified that error appears in the above-identified patent and that said Letters Patent is hereby corrected as shown below:

Column 15, line 5, change "($\Delta P/n \cdot \Delta \downarrow$)" to --($\Delta P/n \cdot \Delta \theta$)--.

Column 16, line 59, after "within" insert --said--.

Signed and Sealed this

Seventeenth Day of September, 1991

*Attest:*

HARRY F. MANBECK, JR.

*Attesting Officer*

*Commissioner of Patents and Trademarks*